US006758027B2

(12) United States Patent
Sting et al.

(10) Patent No.: US 6,758,027 B2
(45) Date of Patent: Jul. 6, 2004

(54) ENVELOPE-FILLING BENCH

(75) Inventors: Martin Sting, Bad Vilbel (DE); Christian Botschek, Rödermark (DE)

(73) Assignee: Pitney Bowes Deutschland GmbH (DE)

( * ) Notice: Subject to any disclaimer, the term of this patent is extended or adjusted under 35 U.S.C. 154(b) by 651 days.

(21) Appl. No.: 09/821,337

(22) Filed: Mar. 29, 2001

(65) Prior Publication Data

US 2003/0182905 A1 Oct. 2, 2003

(30) Foreign Application Priority Data

Mar. 29, 2000 (DE) ..... 100 15 755

(51) Int. Cl.[7] ..... B65B 43/26
(52) U.S. Cl. ..... 53/569; 53/284.3
(58) Field of Search ..... 53/569, 381.5–381.7, 53/284.3, 460, 206

(56) References Cited

U.S. PATENT DOCUMENTS 4,548,400 A 10/1985 Foster et al.
4,756,520 A 7/1988 Clark, Jr. et al.
5,950,399 A * 9/1999 Viens et al. ..... 53/381.6
6,164,046 A * 12/2000 Werner et al. ..... 53/569

FOREIGN PATENT DOCUMENTS

DE 3146788 A1 6/1982
DE 19500746 A1 7/1996

* cited by examiner

*Primary Examiner*—Stephen F. Gerrity
(74) *Attorney, Agent, or Firm*—Michael J. Cummings; Charles R. Malandra, Jr.; Angelo N. Chaclas

(57) ABSTRACT

An envelope-filling bench for adding onto a push-in station of mail-processing machine, the bench containing an envelope-conveyor for transporting envelopes in front of the push-in station and for transporting them away once the envelopes have been filled with enclosures or sets of enclosures. The envelope-filling bench formed essentially from two vertical transverse partition walls, which are spaced apart parallel to one another, a sheet-metal C-profile support, which runs horizontally the direction perpendicular to the transverse partition walls, and a sheet-metal L-profile support, which is welded into said sheet-metal profile support. It being the case that openings and cutouts in the walls of box chamber enclosed by the sheet-metal supports are produced by punching sheet-metal blanks prior to the production of the sheet-metal supports by angling operations. The openings and bores in the walls of said box chamber serve for receiving bearings of shafts and spindles for rollers wheels of the envelope-conveyor.

6 Claims, 5 Drawing Sheets

ENVELOPE-FILLING BENCH

TECHNICAL FIELD

The invention relates to an envelope-filling bench for adding onto a push-in station of a mail-processing machine, in which enclosures or sets of enclosures are conveyed into the push-in station by means of a conveyor and are pushed into envelopes by means of a push-in arrangement, said envelopes being conveyed, on the envelope-filling bench, into a position opposite the push-in arrangement, opened there, held ready for receiving the enclosures or the sets of enclosures and, once filled, being closed and conveyed further. Mail-processing machines of this type are known in general and described, for example, in DE-195 00 746 A1. U.S. Pat. No. 4,955,185 also discloses an installation of the type in question here.

RELATED ART

If the apparatuses for handling and conveying the envelopes are integrated in the mail-processing machine, they necessitate a comparatively complicated construction of the overall drive system, for which reason it is sought to construct a mail-processing machine from individual units which are each assigned to a certain function within the operating sequence and are only mechanically coupled or synchronized to a limited extent and are predominantly coordinated with one another electronically in their respective operating cycle or operating sequence. This achieves the situation where individual operating units of a mail-processing machine, depending on the application or requirement, may be of easily handleable design and assembled in a modular manner to form a wide variety of systems. This use of individual operating stations, however, in some cases necessitates a comparatively complicated housing construction and frame construction with an associated increase in the production costs.

SUMMARY OF THE INVENTION

Accordingly, the object of the invention is to design an envelope-filling bench of the type mentioned in the introduction such that it can be produced easily and cost-effectively and can be adapted to many different methods of envelope handling and transportation.

Particularly worth emphasizing is the advantage of the envelope-filling bench specified here that the latter can be welded together from angled sheet-metal parts, the envelope-filling bench containing, once the angled sheet-metal parts have been combined, a high-strength box profile of which the walls, as well as other regions of the angled sheet-metal parts, are provided with cutouts, through-passages and openings which are produced by straightforward punching operations prior to the angling operation.

The envelope-filling bench proposed here is distinguished, along with good dimensional stability and strength, by low weight and, in certain applications, can be attached to push-in stations of mail-processing machines without having its own support in relation to the underlying surface.

BRIEF DESCRIPTION OF THE DRAWINGS

An embodiment is described in more detail hereinbelow with reference to the drawing, in which.

DETAILED DESCRIPTION OF THE INVENTION

Figure 1:
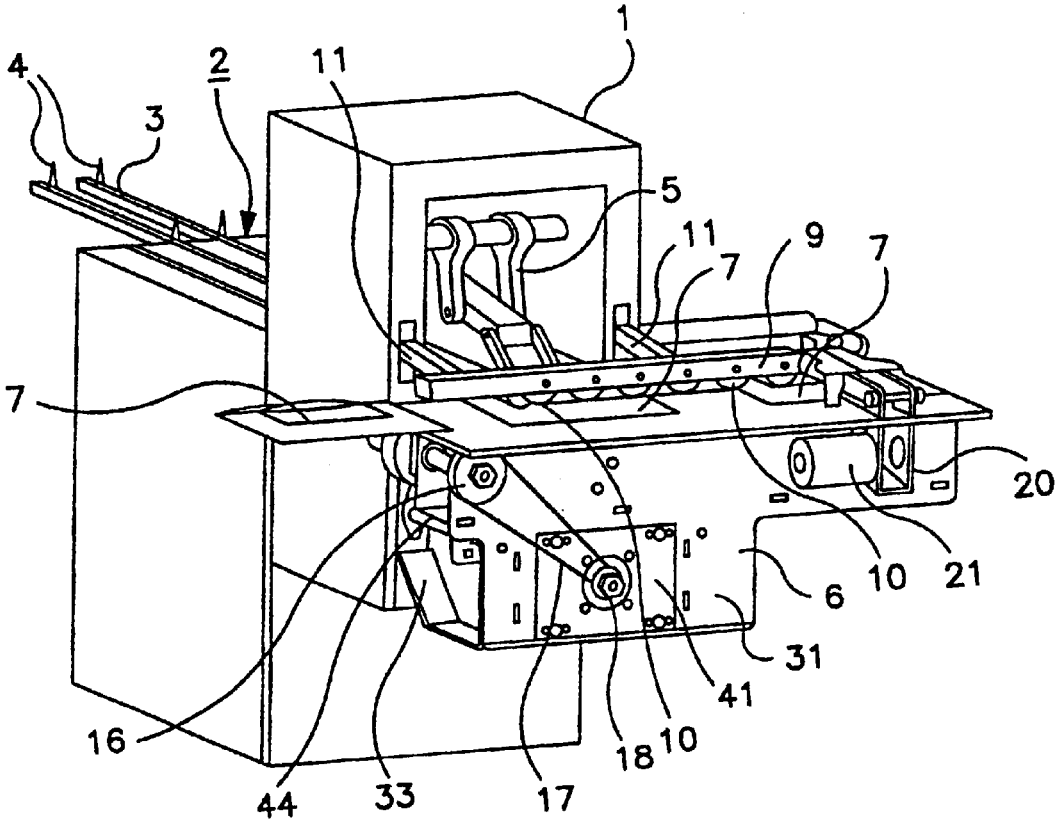
FIG. 1 illustrates a perspective view of part of a mail-processing machine with an envelope-filling bench of the type specified here.

FIG. 1 shows a push-in station 1 of a mail-processing machine 2, of which only the part bordering the push-in station 1 is shown and which contains a conveying chain 3. The conveying chain 3 is equipped with conveying fingers 4, the conveying fingers 4 projecting up from the top strand of the conveying chain 3 forming, in pairs, compartments for enclosures or sets of enclosures which are positioned on the conveying chain and are conveyed into the push-in station 1 by the conveying chain 3.

The push-in station contains a push-in arrangement 5 which is coordinated with the operating speed of the conveying chain 3 and, in a manner which is familiar to the person skilled in the art, grips the enclosures or sets of enclosures by means of push-in fingers and pushes them into envelopes 7 which are held ready in an open state on the top side of an envelope-filling bench 6. The envelopes 7 are conveyed, on the top surface of the envelope-filling bench, into a position opposite the push-in arrangement 5 and opened, held ready for receiving the enclosures or sets of enclosures and, when filled, are closed and conveyed further, as can be seen from the illustration according to FIGS. 1 and 2.

The essential parts for conveying and handling the envelopes 7 are formed, on the one hand, by an envelope-conveying belt 8, of which the top strand runs approximately level with the top side of the envelope-filling bench 6, and, on the other hand, a roller bar 9 with a number of spring-mounted rollers 10, of which the bottom circumferential regions can be pressed against the envelope-conveying belt 8 in order to form envelope-conveying gaps. Actuating arms 11 routed out of the housing of the push-in station 1 connect the roller bar 9 to a drive mechanism which is located in the housing of the push-in station 1 and is intended for pressing the roller bar 9 onto the top strand of the envelope-conveying belt 8, or raising it off therefrom, in accordance with a desired operating cycle of the conveying and handling operation of the envelopes on the surface of the envelope-filling bench 6, which will be discussed in more detail at a later stage in the text.

The envelope-conveying belt 8 is oriented perpendicularly to the conveying direction of the conveying chain 3 and is routed over three toothed-belt pulleys 12, 13 and 14 which are mounted on the envelope-filling bench 6 and of which the axes are oriented horizontally parallel to one another. The envelope-conveying belt 8 is designed as a toothed belt and is adapted to the circumferential profiling of the toothed-belt pulleys 12, 13 and 14. The toothed-belt pulley 13 is seated on a shaft 15 which, at the end 13 remote from the toothed-belt pulley 13, bears a drive toothed-belt pulley 16 which is coupled, via a toothed belt 17, to a toothed-belt pulley 18 which is seated on the drive shaft of a drive motor 19 flanged onto a wall of the envelope-filling bench 6.

In addition to the envelope-conveying belt 8, the envelope-filling bench 6 contains, in a transverse conveying housing 20 connected thereto, a transverse conveying belt which is directed over corresponding rollers and can be made to circulate by means of a drive motor 21, the drive motor 21 being flanged onto the transverse conveying housing 20, as can be seen from the illustration from FIG. 1. The conveying belt circulating in the transverse conveying housing 20 is used in order for the envelopes delivered from an envelope stack to be brought into the region of the envelope-conveying belt 8, which interacts with the roller bar 9, this taking place by the envelopes being conveyed parallel to the conveying direction of the conveying chain 3 laterally past the housing of the push-in station 1. If an envelope is then located in the gripping region of the conveying belt 8, which interacts with the roller bar 9, it is then, with the conveying belt 8 operational and the roller bar 9 lowered, made to move in a conveying direction perpendicular to the conveying direction of the conveying chain 3 and conveyed into a position in front of the push-in arrangement 5 and brought to a standstill there by running up against a controllable stop and the conveying belt 8 being brought to a standstill. Once filled, the envelope is then, with the stop drawn back and the conveying belt 8 operational again and the roller bar 9 lowered, conveyed further.

Figure 2:
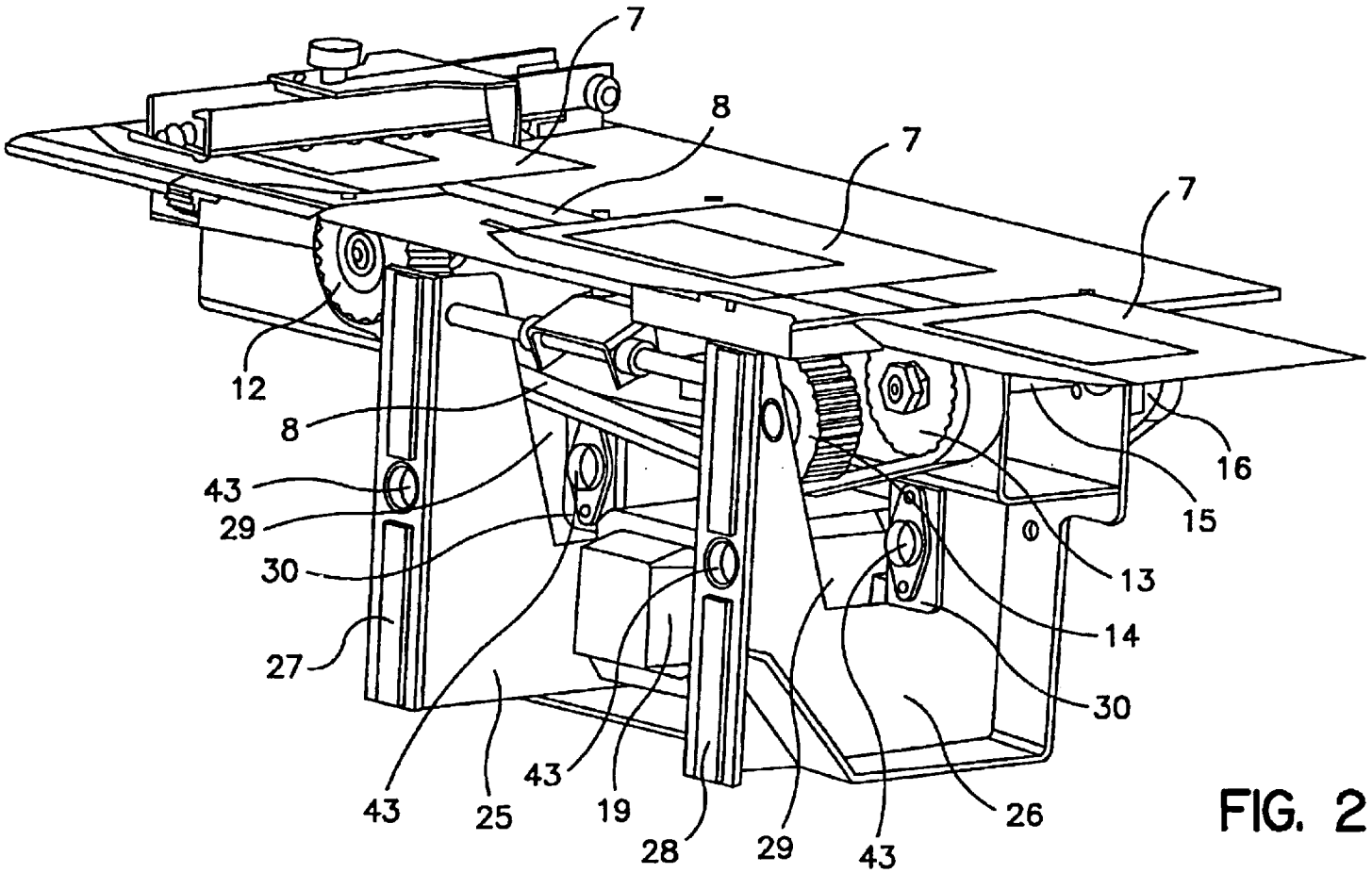
FIG. 2 illustrates a perspective illustration of the envelope-filling bench according to FIG. 1 as seen from the add-on side.

The individual positions of the envelope can be seen from FIG. 2. The operations of opening the envelopes, stopping them for the envelope-filling operation and reclosing them are known to the person skilled in the art and are not essential to the understanding of the present invention, so they will not be described in any more detail here.

Figure 6:
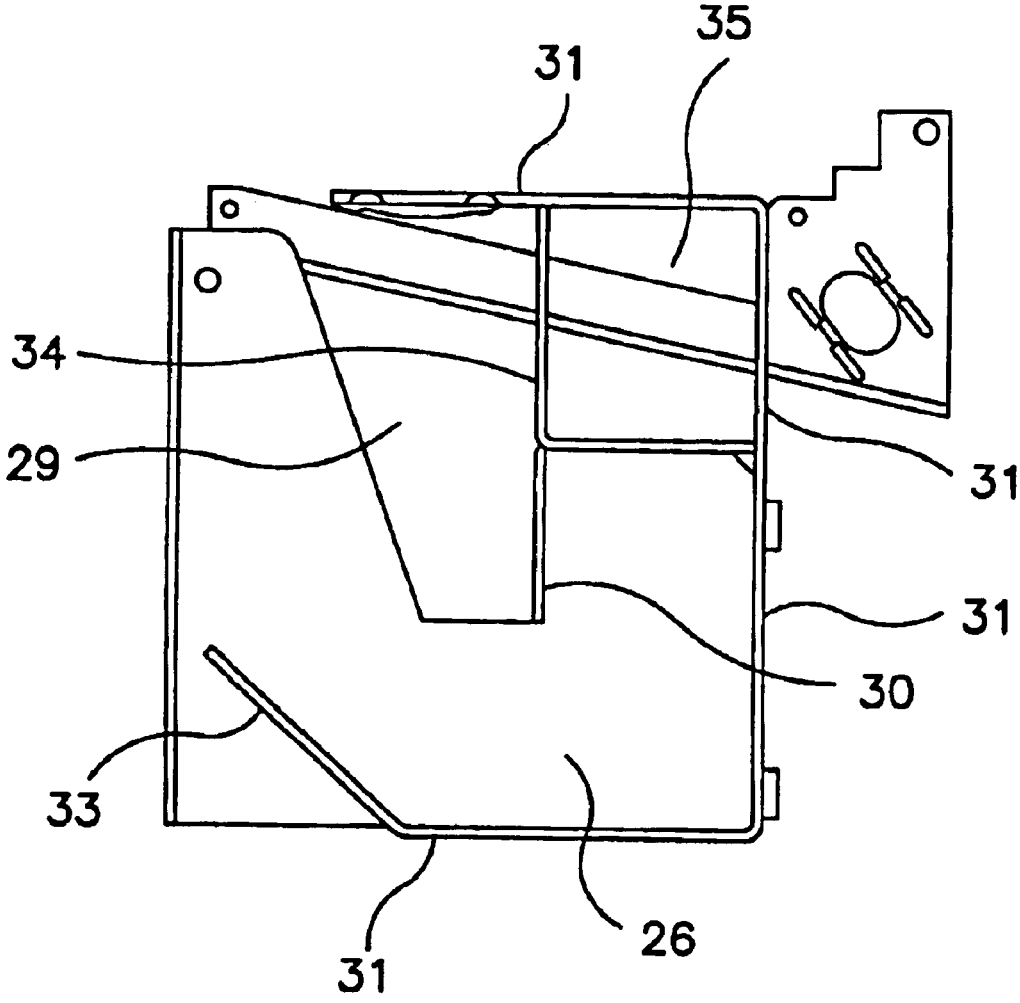

The housing or the frame of the envelope-filling bench 6 contains two mutually parallel vertical transverse partition walls 25 and 26 which have their main parts oriented perpendicularly to the running direction of the envelope-conveying belt 8 and of which the configuration can be seen from FIG. 6 in relation to a viewing direction parallel to the running direction of the envelope-conveying belt 8. The transverse partition walls 25 and 26 have retaining flanges 27 and 28, respectively, which are formed by angling, are directed towards the push-in station 1 and butt against the housing of the latter. Furthermore, punched cutouts 29 are formed in the transverse partition walls 25 and 26. Material of the transverse partition walls 25 and 26 which is cut out during the production of the cutouts 29 is bent over, in the form of lugs 30, in a direction parallel to the retaining flanges 27 and 28.

The transverse partition walls 25 and 26 are welded into the bottom part of a sheet-metal C-profile support 31. The configuration of the top flange of the sheet-metal C-profile support 31 can be seen from FIG. 4 and the configuration of the vertical wall of the sheet-metal C-profile support 31, directed towards the viewer of FIG. 1, can be seen from FIG. 5. The bottom horizontal flange of the sheet-metal C-profile support 31 contains a section 32, extending between the transverse partition walls 25 and 26, and flange strips 33 which adjoin said section laterally and of which the free ends are bent upwards and, laterally, welded firmly on the transverse partition walls 25 and 26 in order to give the latter lateral support.

Above the region in which parts of the transverse partition walls 25 and 26 are located a sheet-metal L-profile support 34 is welded into the space bounded by the sheet-metal C-profile support 31 such that the sheet-metal C-profile support 31 and the sheet-metal L-profile support 34 enclose a box chamber 35 which runs parallel to the conveying direction of the envelope-conveying belt 8. The vertical walls of the box chamber 35, namely the respective vertical parts of the sheet-metal C-profile support 31 and of the sheet-metal L-profile support 34, are provided with bores and openings and/or cutouts, which are designated in general terms by 36 in the drawing and serve for receiving bearings and fastenings for spindles and shafts for driving and supporting the envelope-handling means. The bores, cutouts, openings and the like are provided in the vertical walls of the box chamber 35 by punching operations and machining operations prior to the angling operation of the sheet-metal C-profile support and of the sheet-metal L-profile support and, once said sheet-metal supports have been angled and fastened on one another, pass into the respectively desired, if appropriate aligned positions. This manner of producing the housing or framework of the envelope-filling bench simplifies, and reduces the cost, of the production of the same to a considerable extent.

Figure 4:
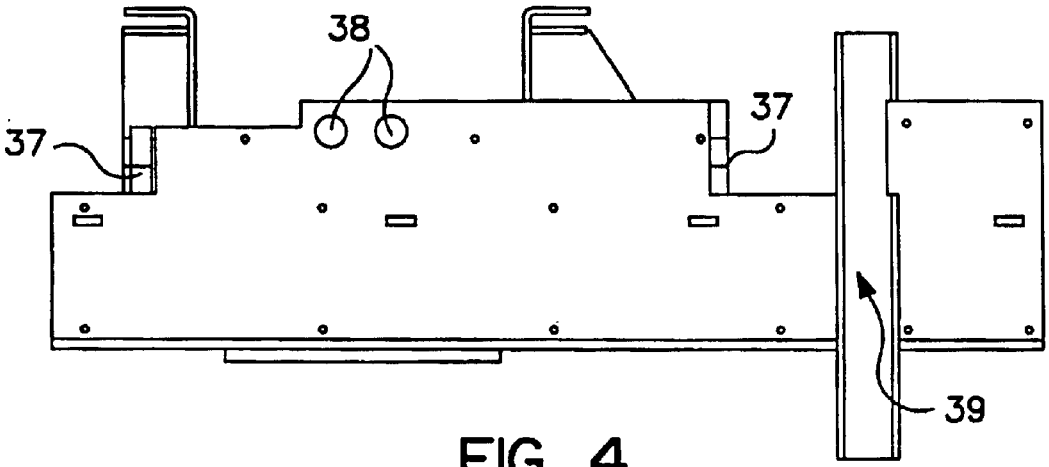

It is also possible for cutouts, openings, bores and the like provided in or on the top flange of the sheet-metal C-profile support to be produced preferably by punching prior to the angling operation of the sheet-metal C-profile support. The top flange of the sheet-metal C-profile support 31 thus contains cut-out, downwardly bent extensions 37 at the beginning and at the end of that region of the top surface of the envelope-filling bench over which the envelope-conveying belt 8 is routed. In FIG. 4, 38 shows circular cutouts through which a suction-cup arrangement acts in order to secure the envelope flap upon opening of the envelope.

Figure 5:
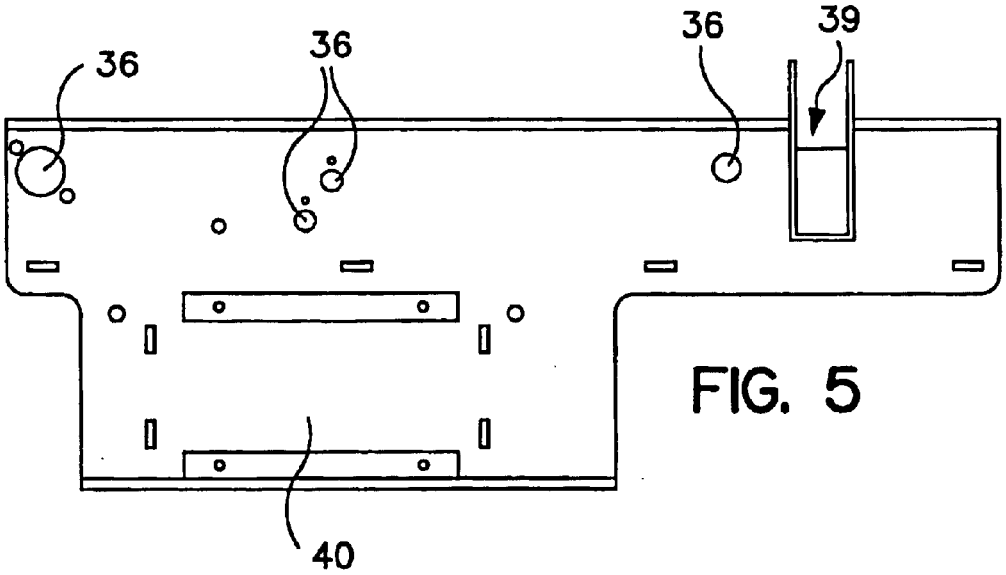

In FIGS. 4 and 5, 39 designates a cutout in the sheet-metal C-profile support 31 which runs transversely to the conveying direction of the envelope-conveying belt 8, extends over the top flange and also over the vertical wall part of said support and serves for receiving the abovementioned transverse conveying housing 20.

Figure 3:
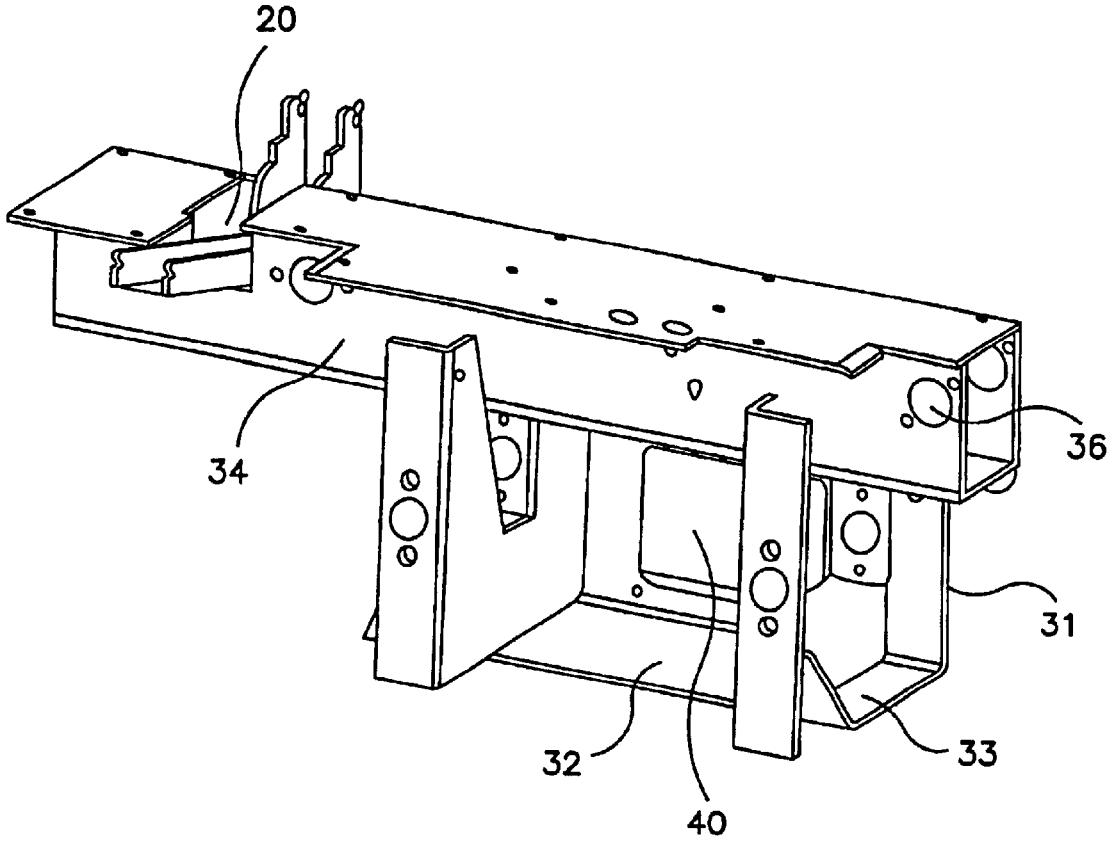
FIG. 3 illustrates a perspective illustration of the envelope-filling bench similar to the illustration from FIG. 2, but with essential parts of the envelope-handling means removed, and FIGS. 4, 5 and 6 respectively illustrate a plan view, a side view and an end view of the envelope-filling bench according to FIGS. 1 to 3.

It is also possible to see, from FIGS. 3 and 5, a rectangular cutout 40 of the vertical wall of the sheet-metal C-profile support 31. The cutout 40 is likewise formed by a punching operation prior to the angling operation of the sheet-metal support and has, on its border, fastening means on which an installation plate 41 (see FIG. 1) can be clamped firmly, the drive motor 19 being flanged on said installation plate. The fastening means between the border of the cutout 40 and the installation plate 41 may be of adjustable design, in order for it to be possible to adjust the distance between the belt pulley 16 and the belt pulley 18.

Drive shafts and bearing journals for the toothed-belt pulleys 12, 13 and 14 are supported in bearings on the vertical walls of the box chamber 35. The toothed-belt pulleys 12, 13 and 14 are all located on that side of the box chamber 35 which is directed towards the cutouts 29 of the transverse partition walls 25 and 26, such that it is possible for the envelope-conveying belt 8, without any further installation measures being required, to be pushed laterally, from the side of the cutouts, onto the toothed-belt pulleys and onto that part of the top flange of the sheet-metal C-profile support 31 which supports the conveying belt.

Provided in the retaining flanges 27 and 28, on the one hand, and the bent lugs 30, on the other hand, are openings 43 which are aligned in a horizontal direction and on which adjustable bushings may be fastened. The openings 43 serve for receiving retaining supports 44 which pass through and project horizontally away from that end wall of the push-in station 1 which butts against the retaining flanges 27 and 28. The retaining supports 44 may be designed such that they can absorb the entire weight of the envelope-filling bench 6, with the result that the latter manages without any support means in relation to the underlying surface.

What is claimed is:

1. An envelope-filling bench for adding onto a push-in station of a mail-processing machine, in which enclosures or sets of enclosures are conveyed into the push-in station by means of a conveyor and are pushed into envelopes by means of a push-in arrangement, said envelopes being conveyed, on the envelope-filling bench, into a position opposite the push-in arrangement, opened, held ready for receiving the enclosures or sets of enclosures and, once filled, being closed and conveyed further, characterized in that the envelope-filling bench has two vertical, mutually parallel transverse partition walls which can be connected to an end wall of the push-in station, run transversely to the envelope-transporting direction and extend in a bottom region of an angled sheet-metal C-profile support, which extends in the envelope-transporting direction and opens towards the push-in station, and are fastened on said support, in that an angled sheet-metal L-profile support is welded to the sheet-metal C-profile support so as to form, in the top part of the sheet-metal C-profile support, a box chamber which has a rectangular cross section and runs in the envelope-conveying direction, and in that mounted on the side walls of the box chamber, in pre-punched openings of the sheet-metal C-profile support and/or the sheet-metal L-profile support, are horizontal shafts or spindles of rollers of envelope-conveying means, which convey envelopes on the top outer surface of the sheet-metal C-profile support.

2. An envelope-filling bench according to claim 1, wherein the bottom region of the sheet-metal C-profile support, between the transverse partition walls, a drive motor is flanged on the vertical wall of the sheet-metal C-profile support and bears on its shaft, on that side of the vertical wall of the sheet-metal C-profile support which is remote from the push-in station, a belt pulley which is coupled, via a drive belt, to a drive wheel or a drive belt pulley for the envelope-conveying means.

3. An envelope-filling bench according to claim 1, wherein shafts and/or spindles bear the rollers or wheels of the envelope-conveying means in a floating manner on that side of said box chamber which is directed towards the push-in station, such that an envelope-conveying belt or an envelope-transporting chain may be positioned directly on the rollers or wheels, or removed therefrom, essentially without any dismantling measures being required.

4. An envelope-filling bench according to claim 1, wherein the transverse partition walls have vertical flanges which are formed by angling, are oriented parallel to the envelope-conveying direction and in which there are provided openings which can be pushed over retaining supports projecting away from the end wall of the push-in station.

5. An envelope-filling bench according to claim 1, wherein cut-out side strips of the bottom part of the sheet-metal C-profile support are bent upwards alongside the transverse partition walls, in order to stiffen and support the latter, and are welded firmly on the transverse partition walls.

6. An envelope-filling bench according to claim 1, wherein at that end of the box chamber which is located counter to the envelope-conveying direction, in the top and side walls of said box chamber, a transverse incision is formed by corresponding punched cutouts of the sheet-metal C-profile support and of the sheet-metal L-profile support, said incision serving for receiving a transverse conveying housing which contains a circulating conveying belt whose top strand is located approximately in the plane of the top side of the envelope-filling bench.

* * * * *